United States Patent [19]

Rittmann et al.

[11] Patent Number: 4,934,222

[45] Date of Patent: Jun. 19, 1990

[54] ERGONOMIC TOOL

[75] Inventors: Nancy C. Rittmann, Racine; Donald D. Grover, Kenosha, both of Wis.

[73] Assignee: Snap-on Tools Corporation, Kenosha, Wis.

[21] Appl. No.: 758,311

[22] Filed: Jul. 24, 1985

[51] Int. Cl.[5] ..... B25B 7/00

[52] U.S. Cl. ..... 81/427.5; 81/415

[58] Field of Search ..... 81/427.5, 414, 415, 81/380–409; 30/199, 193, 248, 257

[56] References Cited

U.S. PATENT DOCUMENTS

| | | | |
|---|---|---|---|
| D. 142,867 | 11/1945 | Johnson Jr. . | |
| D. 142,888 | 11/1945 | Miller . | |
| D. 172,591 | 7/1954 | Gauthier . | |
| D. 255,980 | 7/1980 | Winget . | |
| D. 272,984 | 3/1984 | Shaffer . | |
| D. 276,880 | 12/1984 | Tozaburo . | |
| 378,585 | 2/1888 | Gibson . | |
| 2,421,339 | 5/1947 | Leger . | |
| 2,488,484 | 11/1949 | Vander Clute . | |
| 2,913,943 | 11/1959 | Carlson et al. | 81/427.5 |
| 2,954,606 | 10/1960 | Peak . | |
| 3,080,900 | 3/1963 | Rosenberg . | |
| 3,122,774 | 3/1964 | Lamb . | |
| 3,142,212 | 7/1964 | Grape | 81/383.5 |
| 4,038,719 | 8/1977 | Bennett . | |
| 4,154,273 | 5/1979 | Pollak . | |
| 4,217,686 | 8/1980 | Dragan . | |
| 4,363,344 | 12/1982 | Pollak . | |

OTHER PUBLICATIONS

Production Engineering, May 1982, vol. 29, No. 5.

Jensen's Klein Fatigue Reducing Pliers, fall catalog 1977, p. 91.

Ergonomic Principles in the Design of Hand Tools, T. M. Fraser, 1980.

Literature on cutters of Utica Tool Co., Inc.

*Primary Examiner*—D. S. Meislin

*Attorney, Agent, or Firm*—Emrich & Dithmar

[57] ABSTRACT

The tool is a pliers or cutters having two members that are pivotally joined. The portions of the members on one side of the joint define cutter jaws or plier jaws as the case may be. On the other side of the joint, the members define handles located on the same side of the jaw axis. The rear handle has a first section nearest its associated jaw extending away from the jaw axis at an acute angle, and a second section extending from the first section at an obtuse angle. The other handle also has two sections, the first section nearest the jaws having a slight curvature and the second section having a curvature which is convex outwardly and is more pronounced than that of the first section.

15 Claims, 1 Drawing Sheet

ERGONOMIC TOOL

BACKGROUND OF THE INVENTION

This invention relates generally to an ergonomic tool, such as a pliers or cutters, having pivotally interconnected members. In the usual pliers or cutters, the handles are basically in line with the jaw members. The handles are curved so as to be convex outwardly, but a line drawn between the ends of each handle would generally be aligned with the jaw axis, that is, the axis through the line of engagement of the jaws when closed.

The use of such implement is not difficult for one who uses it sporadically. In other words, the handyman around the house or the service station operator will use such an implement once in a while without deleterious effect.

However, it has been established that there may be significant adverse consequences to people on factory production lines who use such implements continuously. For example, pliers are used to bend or guide wires into holes and to position other materials. In a typical mass production line, the worker sits at a table, holds the cutters or pliers and works on a workpiece such as a printed circuit board lying on the table. This requires the person to flex his wrist so that the hand is tilted downwardly. This could cause damage in the wrist area. Alternatively, the workman would drop his hand below the level of his arm and raise his elbow so that the arm is inclined downwardly to enable him to manipulate the pliers or cutters to work on the printed circuit board. This would be uncomfortable.

A pliers or a cutters is commonly of a size that one handle is engaged by the fingers at one of the joints, while the other handle rests in the palm. The pressure on the palm area resulting from extensive use causes carpal tunnel syndrome which affects the nerves in the palm area and results in pain and/or partial disability of the hand and the wrist. There is a tendency to cut blood circulation and pinch nerves and, therefore, minimize control in that area.

Some ergonomic pliers/cutters have been developed. However, their construction does not entirely alleviate both of these problems. In other words, one would still bend his wrist in order to use them. Also, they are constructed such that one of the handles will contact the sensitive palm area. Also, the curved configuration of the handles tends to draw the user's hand toward the joint during use, making it more difficult to use such an implement.

SUMMARY OF THE INVENTION

It is, therefore, an important object of the present invention to provide an ergonomic tool, such as a cutters or pliers, in which the jaws extend generally in the same direction as one's index finger when they are held and operated so that flexure of the wrist is minimized.

Another object of the present invention is to provide an ergonomic tool such as a pliers or cutters, wherein the handles do not contact the person's palm area so as to minimize carpal tunnel syndrome.

Another object is to provide an ergonomic pliers/-cutters in which the hand is not drawn toward the joint as the the jaws are closed.

In summary, there is provided an ergonomic tool comprising first and second elongated members pivotally joined intermediate their ends, the portions of the members on one side of the pivotal joint respectively defining first and second jaws that are engageable along a jaw axis, the portions of the members on the other side of the pivotal joint defining first and second handles, the first handle extending generally transverse to the jaw axis, the second handle extending from the second jaw on the same side of the jaw axis as the first handle, the second handle including a first section extending from the second jaw and a second section extending from the first section, the first section extending away from the jaw axis at an acute angle, the angle between the first and second sections being obtuse.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
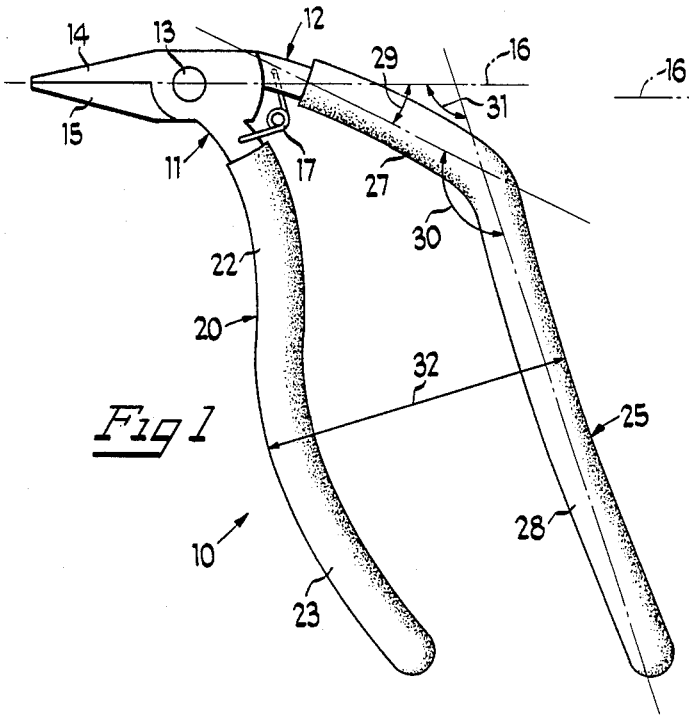
FIG. 1 depicts an ergonomic pliers incorporating the features of the present invention, the pliers being in their closed condition.
Figure 2:
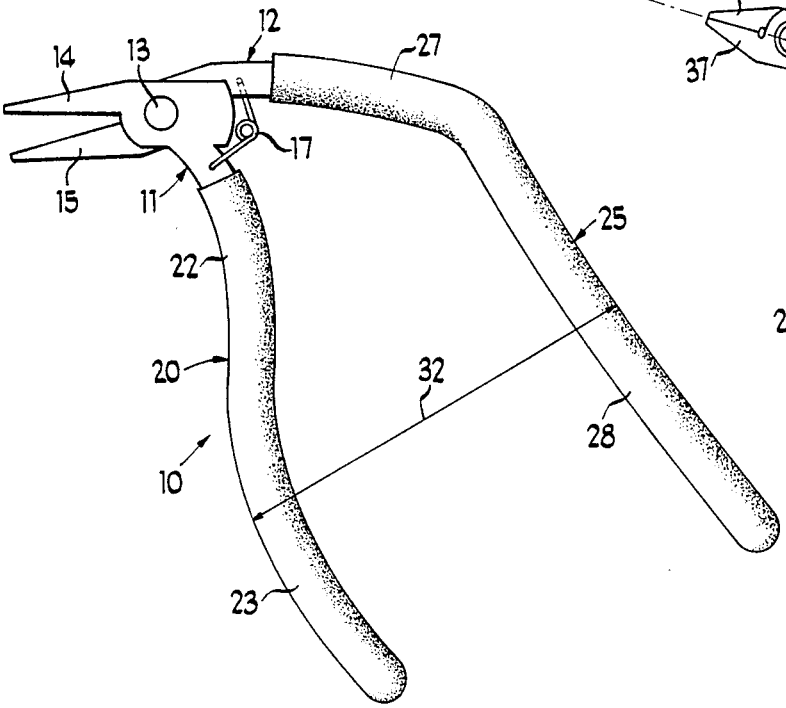
FIG. 2 depicts the ergonomic pliers in their open position.

Turning now to the drawings, and more particularly to FIGS. 1 and 2 thereof, there is depicted an ergonomic pliers 10 incorporating the features of the present invention. The pliers 10 includes a first member 11 and a second member 12 pivotally interconnected at a joint 13. The portion of the member 11 to the left of the joint 13 defines a jaw 14, while the portion of the member 12 to the left of the joint 13 defines a jaw 15. When the jaws 14 and 15 are closed, they engage along a jaw axis 16. A spring 17 biases the jaws 14 and 15 to the open condition depicted in FIG. 2 .

The portions of the members 11 and 12 on the other side of the joint 13 define handles 20 and 25. Each handle preferably has a soft rubber or plastic coating, as shown. The handle 20 extends generally transverse to the jaw axis 16 and has sections 22 and 23. The section 22 extends from the jaw 14 and has a slight curvature, for example, a ten-inch radius. The section 23 has a more substantial curvature oriented in the opposite direction to that of the section 22, and has, for example, a 3.5 inch radius.

The handle 25 extends from its associated jaw on the same side of the jaw axis 16 as the handle 20. The handle 25 also has two sections, 27 and 28. The sections 27 and 28 are generally straight. The section 27 extends away from the jaw axis 16 at an acute angle 29. The angle 30 between the sections 27 and 28 is obtuse. Actually, the section 28 has a slight curvature, for example, about sixteen inches. In an actual embodiment, the angle 29 was about 25°, the angle 30 was about 135°, and the angle 31 between the axis of the section 28 and the jaw axis 16 was about 110°.

Figure 3:
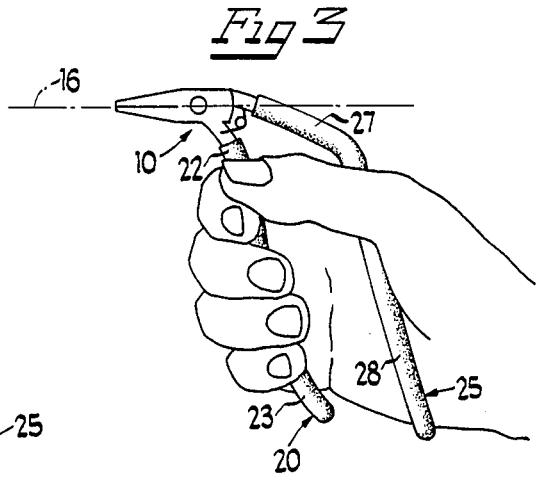
FIG. 3 depicts the pliers being held by a person's hand.

Referring to FIG. 3, the pliers 10 is gripped such that the handle 20 is contacted by the phalanges area of the fingers, while the handle 25 is engaged by the fleshy area of the hand aligned with the thumb. It is noteworthy that neither handle is contacted by the palm area of the hand, thereby eliminating possible pressure on the median nerve. The result is less of a tendency to acquire carpal tunnel syndrome or hand-wrist disorders by a person who uses the pliers all day long on a production line. One important reason is that the handles 20 and 25 have the correct spacing. For example, in an operative embodiment, the handles were so constructed that their tips were spaced apart about three inches in the spread condition depicted in FIG. 2 and 1.5 inch when the handles were drawn together as depicted in FIG. 1. This results in the distance 32 across the handles at the center gripping portions being about 2.25 inches in the closed position of FIG. 1 and about three inches in the open position of FIG. 2.

The compound configuration of the handle 25, that is, one having two generally straight sections, 27 and 28, enables the pliers 10 to be in an ideal position in use. The construction and the relationship of the handles 20 and 25, the compound configuration of the handle 25, and the value of the angle 31 causes the jaw axis 16 to point in the same direction as the index finger if it were opened. More particularly, referring to FIG. 3, the hand is shown with all four fingers engaging the handle 20. However, if the index finger was released and instead pointed forwardly, it would be basically pointing in the same direction as the jaws axis 16. It is an important aspect of the invention herein that such orientation is ideal to minimize tiring of the wrist. When the jaws point in the same direction as the extended index finger, the hand can be used with minimum bending at the wrist.

Figure 4:
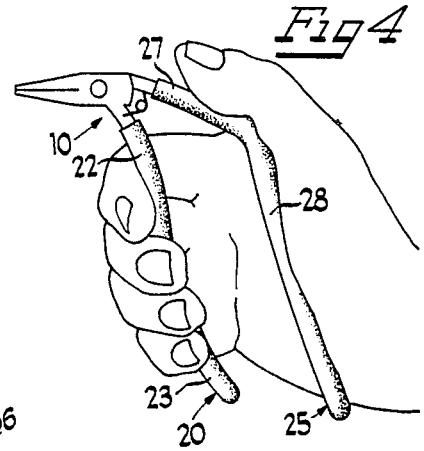
FIG. 4 is a view like FIG. 3, but with the hand in a different position.

The section 27, in addition to providing the correct spacing for the section 28, also provides a thumb rest, as depicted in FIG. 4, if desired.

The curvature of the handle 20 enables it to rest comfortably in the phalanges portion of the fingers, usually between the two joints of the fingers. As can be seen in FIG. 3, the shape and length of the handle 20 enables it to be contacted simultaneously by all four fingers, thereby providing greater distribution of the force and control of the pliers. The length of the handles reduces the force required for a given task which thereby reduces tendency to develop wrist and tendon disorders.

Another advantage of the pliers 10 is that one's hand does not have a tendency to move toward the joint 13 as the pliers is closed. In most prior pliers, particularly ergonomic pliers, the handles are curved, and there is a feeling that the hand is drawn toward the joint during closure. But, the handle 25 has a compound configuration instead of a single large curve. Such constructions minimizes any tendency for the hand to move toward the joint.

Also, the substantial space between the handles 20 and 25 prevents pinching of the palm as the pliers is being closed and optimizes force which can be applied from the gripping action.

Figure 5:
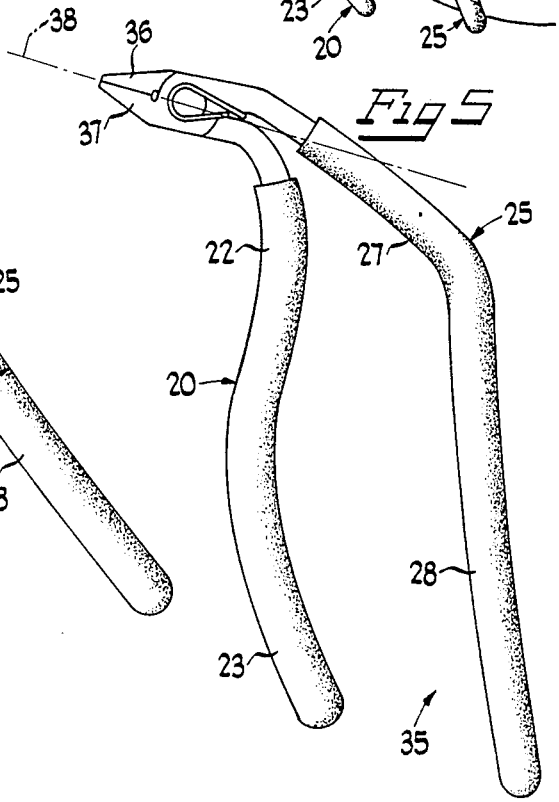
FIG. 5 is a view of a second embodiment of the present invention in which the ergonomic tool is a cutters.

In FIG. 5, there is depicted a pair of cutters having the same handles 20 and 25 in the pliers 10. The cutters 35 has jaws 36 and 37 defining a jaw axis 38. The configuration of the cutter handles is generally the same as that for the pliers. The angle of the cutter jaw axis 38 may vary somewhat from that previously described for the pliers 10, depending on the application.

What has been described, therefore, is an improved ergonomic tool, being a pliers or cutters, which is designed such that the handles are not engaged by the palm of the hand, but rather by the fingers and the base of the thumb and the heel of the hand. In the case of a pliers, the jaws point in the same direction as the index finger of the hand holding them.

We claim:

1. An ergonomic tool comprising first and second elongated members pivotally joined intermediate their ends, the portions of said members on one side of the pivotal joint respectively defining first and second jaws that are engageable along a jaw axis, the portions of said members on the other side of the pivotal joint defining first and second handles, said first handle extending generally transverse to the jaw axis, said second handle extending from said second jaw on the same side of said jaw axis as said first handle, said second handle including a first generally straight section extending from said second jaw and a second generally straight section extending from said first section, said first section extending away from said jaw axis at an acute angle, the angle between said first and second sections being on the order of about 135°, the angle between said jaw axis and said second section being on the order of about 110°, said first section having a length being a substantial portion of the length of said second section, said first handle including a first curved section extending from said first jaw and a second curved section extending from said first curved section, one of said curved sections being convex away from said second handle and the other of said curved sections being convex toward said second handle.

2. The ergonomic tool of claim 1, being a pair of pliers, said jaws being pliers jaws.

3. The ergonomic tool of claim 1, being wire cutters, said jaws being cutter jaws.

4. The ergonomic tool of claim 1, wherein the acute angle between the jaw axis and said first section is about 25°.

5. The ergonomic tool of claim 1, wherein said first curved section is convex toward said second handle, and said second curved section is convex away from said second handle.

6. The ergonomic tool of claim 1, wherein the distance across the gripping portions of said handles is about three inches apart when spread.

7. The ergonomic tool of claim 1, wherein the tips of said handles are about 1.5 inch apart when drawn together.

8. The ergonomic tool of claim 1, wherein each of said handles has a gripping portion, the distance across said gripping portions being about 2.25 inches when drawn together.

9. The ergonomic tool of claim 1, wherein the lengths of said first and second handles are sufficient to allow gripping of said first handle by all four fingers of one's hand and to allow gripping of said second handle by the heel of such hand.

10. The ergonomic tool of claim 1, wherein each of said handles is covered by a soft gripping material.

11. An ergonomic tool comprising first and second elongated members pivotally joined intermediate their ends, the portions of said members on one side of the pivotal joint respectively defining first and second jaws that are engageable along a jaw axis, the portions of said members on the other side of the pivotal joint defining first and second handles, said first handle extending generally transverse to the jaw axis, said second handle extending from said second jaw on the same side of said jaw axis as said first handle, said second handle including a first generally straight section extending from said second jaw and a second generally straight section extending from said first section, said first section extending away from said jaw axis at an acute angle, the angle between said first and second sections being on the order of about 135°, the angle between said jaw axis and said second section being on the order of about 110°, said first section having a length being a substantial portion of the length of said second section, said first handle including a first curved section extending from said first jaw and a second curved section extending from said first curved section, one of said curved sections being convex away from said second handle and the other of said curved sections being convex toward said second handle.

12. The ergonomic tool of claim 11, wherein said first curved section is convex toward said second handle, and said second curved section is convex away from said second handle.

13. The ergonomic tool of claim 11, wherein the distance across the gripping portions of said handles is about three inches apart when spread.

14. The ergonomic tool of claim 11, wherein the tips of said handles are 1.5 inch apart when drawn together.

15. The ergonomic tool of claim 11, wherein each of said handles has a gripping portion, the distance across said gripping portions being about 2.25 inches when drawn together.

* * * * *

UNITED STATES PATENT AND TRADEMARK OFFICE

CERTIFICATE OF CORRECTION

PATENT NO. : 4,934,222

DATED : June 19, 1990

INVENTOR(S) : Nancy C. Rittmann and Donald D. Grover

It is certified that error appears in the above-identified patent and that said Letters Patent is hereby corrected as shown below:

Column 6, line 15, after "are" insert --about--.

Signed and Sealed this

Seventh Day of April, 1992

*Attest:*

HARRY F. MANBECK, JR.

*Attesting Officer*

*Commissioner of Patents and Trademarks*